United States Patent [19]

McEniry

[11] Patent Number: 4,669,690

[45] Date of Patent: Jun. 2, 1987

[54] BAG SUPPORT

[75] Inventor: Denis R. McEniry, Fruitland, Canada

[73] Assignee: Bay City Management Limited, Fruitland, Canada

[21] Appl. No.: 802,096

[22] Filed: Nov. 25, 1985

[30] Foreign Application Priority Data

Nov. 26, 1984 [CA] Canada ..... 468635

[51] Int. Cl.[4] ..... B65B 67/04

[52] U.S. Cl. ..... 248/101; 248/222.2

[58] Field of Search ..... 248/95, 97, 99, 100, 248/101, 222.2; 232/43.2; 141/314, 391

[56] References Cited

U.S. PATENT DOCUMENTS

| | | | |
|---|---|---|---|
| 380,534 | 4/1888 | Allen | 248/100 |
| 2,010,789 | 8/1935 | Roesel | 248/95 |
| 2,491,515 | 12/1949 | Orchard | 248/95 |
| 2,759,695 | 8/1956 | Berner et al. | 248/95 |
| 2,906,478 | 9/1959 | Merrick | 248/95 |
| 3,014,684 | 12/1961 | Gould, Jr. | 248/313 |
| 3,175,793 | 3/1965 | Kennedy | 248/99 |
| 3,313,504 | 4/1967 | Stoltze | 248/99 |
| 3,468,505 | 9/1969 | Reilly | 248/101 |
| 3,664,622 | 5/1972 | Vaccaro | 248/95 |
| 3,704,675 | 12/1972 | Bellasalma | 248/222.2 X |
| 3,838,839 | 10/1974 | Spencer | 248/99 |
| 3,841,592 | 10/1974 | Witten | 248/101 |
| 4,196,880 | 4/1980 | Hynes | 248/99 |
| 4,223,858 | 9/1980 | Salazar | 248/101 |
| 4,378,924 | 4/1983 | Christensen | 248/101 |
| 4,562,983 | 1/1986 | Klefbeck | 248/97 |

FOREIGN PATENT DOCUMENTS

| | | | |
|---|---|---|---|
| 61952 | 12/1898 | Canada | 248/12 |
| 268347 | 2/1927 | Canada | 248/12 |
| 915595 | 11/1972 | Canada | 248/12 |
| 1010007 | 5/1977 | Canada | 248/12 |
| 1100926 | 5/1981 | Canada | 248/12 |
| 1111401 | 10/1981 | Canada | 248/12 |
| 1410343 | 8/1965 | France | 248/99 |

*Primary Examiner*—J. Franklin Foss
*Assistant Examiner*—David L. Talbott
*Attorney, Agent, or Firm*—Rogers & Scott

[57] ABSTRACT

The invention provides a support structure for suspending an open bag from a wall and the like, such as the door of a kitchen cupboard, the support structure having a hoop including a flat rear portion of a selected vertical height. The bag is received inside the hoop with the portion adjacent its mouth folded over the top of the hoop. At least one attachment plate is provided for mounting on the wall. The plate has a downwardly projecting lip, and below the lip a ledge spaced from the bottom edge of the lip by less than the selected vertical extent of the hoop, so that the hoop will be retained by engagement of the rear portion behind the lip, while resting on the ledge. The hoop is thus suspended from the wall extending horizontally and with the mouth open to receive items dropped into the bag, the folded-over portion of the bag being trapped between the hoop and the attachment plate to retain the bag in a manner which increases with the weight in the bag. The hoop is notched or a plurality of clips are provided to hold securely a bag that is otherwise too small for the hoop. A lid is usually provided to close the mouth of the bag.

15 Claims, 6 Drawing Figures

FIG 1
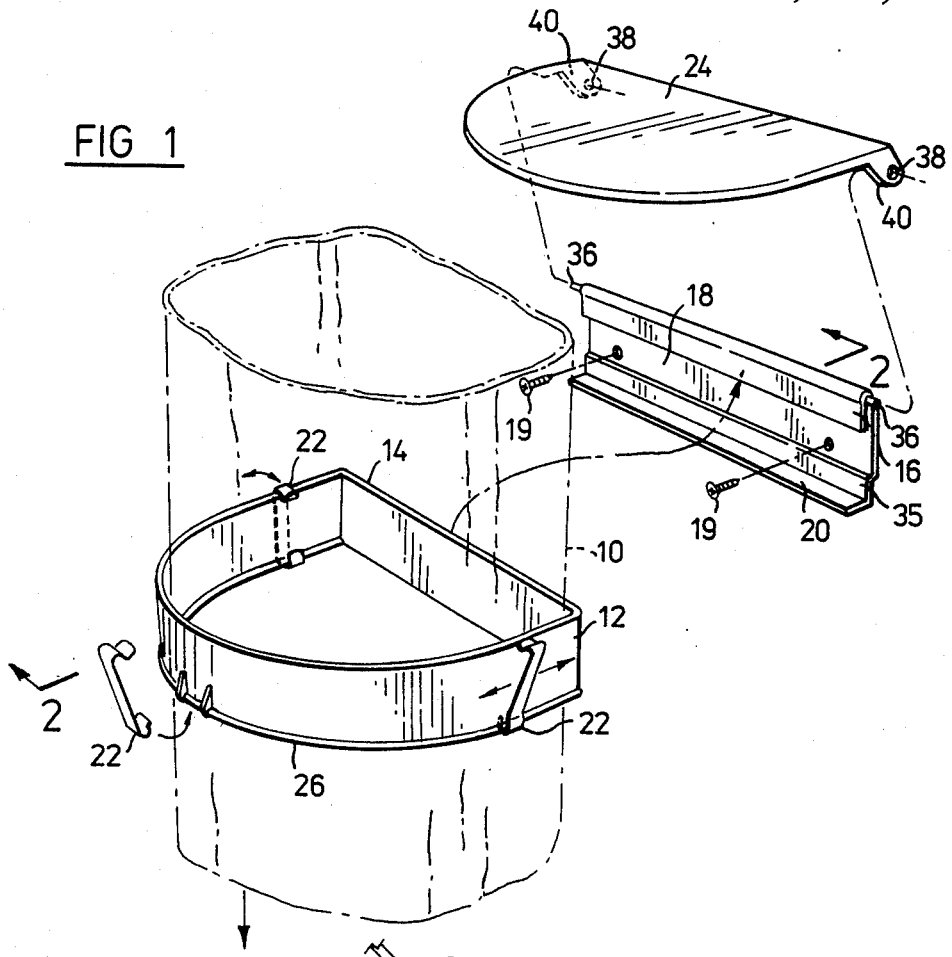
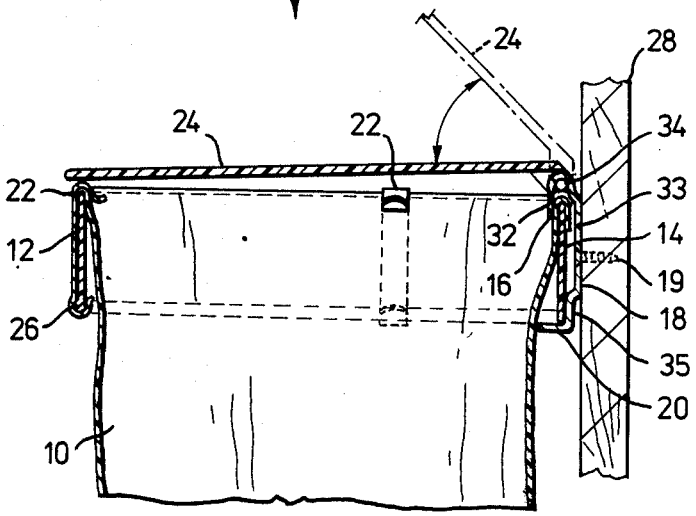
FIG 2

BAG SUPPORT

FIELD OF THE INVENTION

This invention relates to a support structure for attachment to the inside of cupboard doors, or to walls, to provide a convenient support for bags in an open position to receive refuse or the like.

REVIEW OF THE PRIOR ART

Paper and plastic bags are commonly used to receive refuse and it is convenient to have the bag supported from a structure which holds the mouth of the bag open. In use, such a structure is often suspended from a wall, or from the inside surface of a cupboard door, to hold the bag in a convenient location adjacent to the cooking facilities, or wherever refuse is commonly discarded.

It is important to be able to suspend the bag from the support simply and conveniently and also to be able to remove the bag when it is full. It also important that the bag be retained securely on the support, especially as it becomes filled. During use it is preferred it provide a lid over the open mouth of the bag for sanitary reasons and to improve the appearance. It is also useful if the structure can readily accommodate different sizes of paper and plastic grocery bags, since it is now common to dispose of these bags by using them to collect refuse, and if they can be accommodated in the support, then a saving is made because the user does not have to buy bags which are especially sized for the support.

DEFINITION OF THE INVENTION

Accordingly, it is an object of the present invention to provide a support structure for bags adopted to hold a bag in an open position suspended from a wall or from the inside surface of a cupboard door.

In accordance with the present invention there is provided a support structure for retaining and suspending an open bag from a wall, the support structure comprising:

a hoop having a rear portion of its side wall flat and of a selected vertical extent, the bag being received inside the hoop with an upper portion thereof adjacent its mouth folded over at least the top of the flat side wall rear portion of the hoop;

at least one attachment plate for attachment to the wall, the plate having a back wall and a downwardly projecting lip at the upper part of the plate back wall and, below the lip, a forwardly protruding ledge spaced from the bottom edge of the lip by less than said selected vertical extent of the hoop side wall rear portion, so as to receive the lower edge of the hoop side wall rear portion with the upper edge of the hoop side wall rear portion behind the lip and urged under gravity against the lip, and with the lower edge of the hoop side wall rear portion resting under gravity on the ledge, whereby the said upper portion of the bag folded over the top of the flat side wall rear portion is gripped between the side wall rear portion and the downwardly projecting lip to retain the bag on the hoop, and the hoop is suspended from the attachment plate and thereby from the wall and extends generally horizontally with the bag mouth open to receive items dropped into the bag.

BRIEF DESCRIPTION OF THE DRAWINGS

This and other aspects of the invention will now be described with reference to the accompanying drawings, in which:

FIG. 1 is an exploded perspective view of a support structure according to the invention and showing a bag in ghost outline in the process of being mounted into the struture;

FIG. 2 is a side sectional view of the assembled support structure attached to the inside surface of a door and showing the bag in position;

DESCRIPTION OF THE PREFERRED EMBODIMENTS

Figure 3:
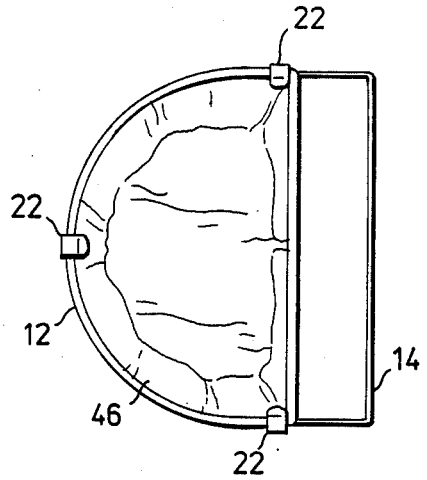
FIG. 3 is a plan view drawn to a smaller scale, showing the support in the structure of a smaller bag with the lid of the structure shown removed.

Reference is made first to FIG. 1 which shows in ghost outline a bag 10 as it is being dropped into a D-shaped hoop 12 from which the bag is to be supported at its mouth. This hoop includes a straight back portion 14 proportioned vertically to engage under a downwardly extending lip 16 of a support attachment plate 18 which terminates at its lower extremity in an outwardly extending ledge 20. The back portion 14 can be engaged under the lip 16 and will rest on the ledge 20 to suspend the bag 10 from a wall or other structure to which the attachment plate is fastened. Three clips 22 are of size and shape to snap over the part of the D-shaped hoop 12 in selected positions to hold the bag more securely, and a lid 24 is pivotally attached to the attachment plate 18 and is of size and shape to cover the mouth of the bag .

The hoop 12 is moulded of any suitable synthetic plastic material and terminates at the bottom extremity in a reinforcing head 28. The hoop can be of any general shape but it is preferably the D-shape shown for improved appearance, and to provide for adequate physical contact between the hoop and the attachment plate. At its front the hoop includes a pair of locating ribs 30 which are spaced apart sufficiently to receive between them the clip 22 disposed at the front of the hoop. Each clip is proportioned to engage under the bead 28 and to snap over the top of the hoop with the plastic bag in position with the upper part of the bag folded over and outwardly around the hoop, as better seen in FIG. 2. The attachment plate 18 is preferably of sheet metal with its upper edge folded forward and downwards to form the lip and its lower edge folded forward to form the ledge, and is attached to a vertical wall 28 (FIG. 2), such as the inside surface of a cupboard door, by a pair of screws 19. The plate has a pivot rod 34 trapped between the outer extremity of the lip 16 and a rearward portion 32 (FIG. 2) above a main back wall portion 33 which is set back from the portion 32. This rod projects beyond the lip at each end to form respective pivots 36 (FIG. 1) which engage in suitable respective openings 38 in a pair of rearwardly projecting parallel lugs 42 formed at the rear of the lid 24. The lid is D-shaped so as to fit over the hoop 12 in the closed position and, because of the rearward inclination of the lugs 44, the lid can be lifted only until it engages the wall when it is still at an angle to the vertical, so that when it is released it will fall under gravity back into the closed position.

Referring to FIG. 2, it will be seen that the plastic bag is trapped by the clips 22 and since the bag illustrated is large enough, it is wrapped over the back portion 14 of the hoop, as shown.

The bag is mounted in the support structure by dropping it through the hoop in the manner illustrated in Figure 1, until a small portion of the bag adjacent the mouth projects above the hoop. This portion is then folded outwardly and over the hoop 12, and if necessary the clips 22, 24, 26 are added. Next, the hoop with the bag in place is entered in an upwardly tilted attitude under the lip 16 of the attachment plate 18. The lip is spaced well clear of the main portion 33 to facilitate such entry. The hoop is then rotated downwardly to place the back portion 14 squarely on the ledge 20 and against a shoulder 35 below the portion 33. This shoulder is positioned to locate the hoop in a horizontal position. It will be appreciated that the load in the bag is supported because the hoop will tend to rotate under gravity downwardly from the position shown in FIG. 2 and this is resisted by the lip 16 and reaction against the shoulder 35, the principal support being provided by the ledge 20. Moreover, as will be seen from FIG. 2, the portion of the bag that is interposed between the hoop and the lip is gripped therebetween to retain the bag as the hoop and the bag are urged downward by gravity, an this gripping increases with the weight of garbage in the bag.

FIG. 3 is drawn to a smaller scale and illustrates the use of a bag 46 which is smaller than the bag 10 and could be of the paper of plastic type used to carry groceries. As will be seen, the bag is too small to extend over the back portion 14 and in this case the two side clips 22 are used to attach the bag as far towards the portion 14 as possible thereby, providing the largest possible opening for access to the bag interior. These clips therefore provide the facility to accommodate different sizes of bags in the same support structure.

Figure 4:
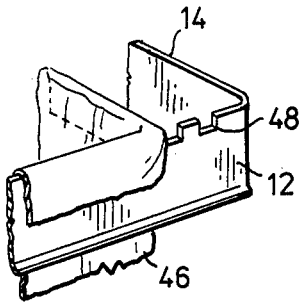
FIG. 4 is a view similar to FIG. 1 showing a part of an alternative hoop for the structure.

An alternative embodiment is illustrated in FIG. 4. In this case the hoop 12 receives a small bag 46 and in order to keep the mouth of the bag open, the top of the hoop carries several notches 48, which are repeated at the other side of the hoop (not shown). The number of notches can be varied but it will be seen that the user first places the bag over the front of the hoop, then pushes the sides as far back as possible without damaging the bag, and finally hooks the bag over edges of the notches to retain it in position. A variety of bag sizes can therefore be accommodated using this embodiment without the need for the clips 22.

Figure 5:
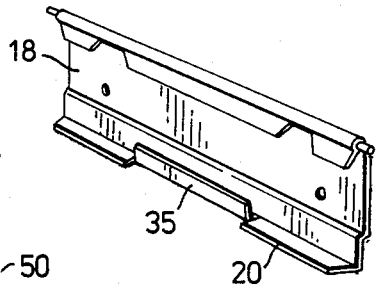
FIG. 5 is a perspective view showing an alternative attachment plate for the structure.

FIG. 5 shows an alternative form of attachment plate 18 in which the extension 35 for holding the hoop in horizontal position is struck up from out of the ledge 20.

Figure 6:
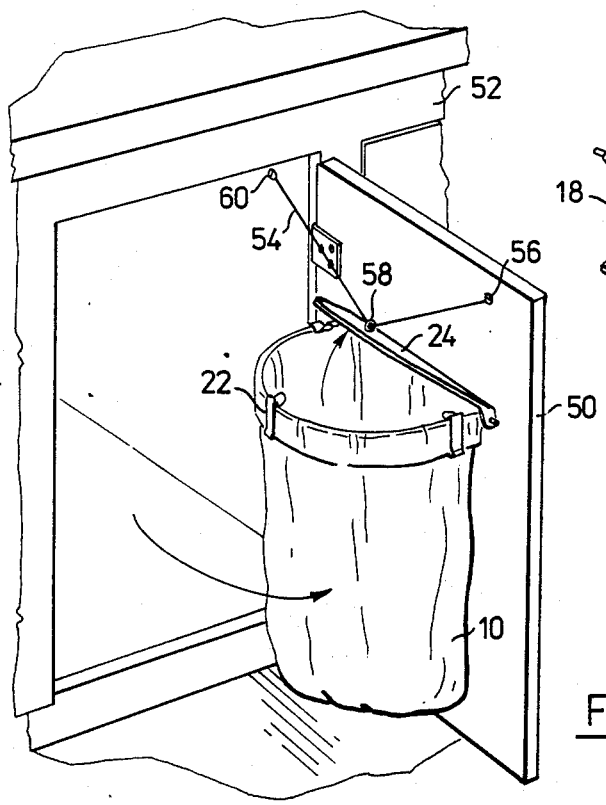
FIG. 6 is a diagrammatic perspective view of a support structure mounted on a door with a self-opening device for the lid attached to the lid, the door and the door-frame.

Reference is now made to FIG. 6 which shows a support structure and bag 10 attached to the inside wall of a cupboard door 50, which is shown in an open position with reference to an associated cupboard 52. A light string 54 is attached to the door at 56 and runs through a metal ring 58 attached to the lid to an anchor 60 on the cupboard. The length of the string is chosen so that as the door opens, the string is tightened and the lid lifts pulled up by the string.

In anothe embodiment which does not need illustration an attachment plate is provided without a lid. The plate would otherwise be like the plate 18 illustrated. This extra support can for example be mounted in a convenient place, such as the edge of a ford preparation area, to be able to attach the hoop and bag thereto to sweep waste off the area directly into the bag. The hoop and bag can then be returned to the normal position inside the cupboard. Of course, the hoop can be used to carry the bag to any location where it is to be used, and these are further advantageous features of the invention.

It will be appreciated that other modifications can be made to the support within the scope of the invention as described and claimed. For example, the attachment plate 18 could consist of a pair of brackets rather than a single piece with the brackets spaced apart sufficiently to perform the same function as a single plate 18.

I claim:

1. A support structure for retaining and suspending an open bag from a wall, the support structure comprising:

a hoop having a rear portion of its side wall flat and of a selected vertical extent, the bag being received inside the hoop with an upper portion thereof adjacent its mouth folded over at least the top of the flat side wall rear portion of the hoop;

at least one attachment plate for attachment to the wall, the plate having a back wall and a downwardly projecting lip at the upper part of the plate back wall and, below the lip, a forwardly proturding ledge spaced from the bottom edge of the lip by less than said selected vertical extent of the hoop side wall rear portion, so as to receive the lower edge of the hoop side wall rear portion with the upper edge of the hoop side wall rear portion behind the lip and urged under gravity against the lip, and with the lower edge of the hoop side wall rear portion resting under gravity on the ledge, whereby the said upper portion of the bag folded over the top of the flat side wall rear portion is gripped between the side wall rear portion and the downwardly projecting lip to retain the bag on the hoop, and the hoop is suspended from the attachment plate and thereby from the wall and extends generally horizontally with the bag mouth open to receive items dropped into the bag.

2. A support structure as claimed in claim 1, in which the hoop is of D-shape with the straight portion of the D constituted by the said flat rear portion of the hoop side wall.

3. A support structure as claimed in claim 2, and further including a lid pivoted to the attachment plate for movement between a closed position covering the mouth of the bag and an open position to provide access to the bag.

4. A support structure as claimed in claim 3, and further comprising string means attachable to the lid to the cupboard door, and to a fixed part of the cupboard, so that as the cupboard door is opened, the string means is tensioned and the lid is opened.

5. A support structure as claimed in claim 3, wherein the attachment plate has pivot means interposed between the plate downwardly projecting lip and the plate back wall above the lip and projecting transversely beyond the lip at each end thereof; and the lid is pivotally mounted on the said pivot means for movement between the said closed and open positions.

6. A support structure as claimed in claim 1, and further comprising clips attachable to the part of the hoop other than the flat side wall rear portion to overlie the portion of the bag folded over the said other part of the hoop to also hold the bag in place on the hoop.

7. A support structure as claimed in claim 6, and further including a lid pivoted to the attachment plated for movement between a closed position covering the mouth of the bag and an open position to provide access to the bag.

8. A support structure as claimed in claim 7, and further comprising string means attachable to the lid to the cupboard door, and to a fixed part of the cupboard, so that as the cupboard door is opened, the string means is tensioned and the lid is opened.

9. A support structure as claimed in claim 7, wherein the attachment plate has pivot means interposed between the plate downwardly projecting lip and the plate back wall above the lip and projecting transversely beyond the lip at each end thereof; and the lid is pivotally mounted on the said pivot means for movement between the said closed an open positions.

10. A support structure as claimed in claim 1, and further including a lid pivoted to the attachment plate for movement between a closed position covering the mouth of the bag and an open position to provide access to the bag.

11. A support structure as claimed in claim 10, wherein the wall is constituted by the inside surface of a cupboard door of a cupboard, and further comprising string means attachable to the lid to the cupboard door, and to a fixed part of the cupboard, so that as the cupboard door is opened, the string means is tensioned and the lid is opened.

12. A support structure as calimed in claim 10, wherein the attachment plate has pivot means interposed between the plate downwardly projecting lip and the plate back wall above the lip and projecting transversely beyond the lip at each end thereof; and the lid is pivotally mounted on the said pivot means for movement between the said closed and open positions.

13. A support structure as claimed in claim 1, in which the attachment plate further comprises at the lower part of its back wall a forwardly protruding shoulder against which the lower portion of the hoop rear side wall presses under gravity to maintain it in horizontal attitude.

14. A support structure as claimed in claim 1, wherein the attachment plate is of sheet metal having the lip constituted by its upper edge folded forwards and downwards, and having the lower edge constituted by its lower edge folded forwards, wherein pivot means are disposed between the folded lip and the plate back wall and project transversely beyond the lip at each end thereof.

15. A support structure as claimed in claim 14, in which the attachment plate further comprises at the lower part of its back wall a forwardly protruding shoulder against which the lower portion of the hoop rear side wall presses under gravity to maintain it in horizontal attitude.

* * * * *